United States Patent [19]

Hayakawa et al.

[11] Patent Number: 4,850,581

[45] Date of Patent: Jul. 25, 1989

[54] AUTOMATIC SHEET SUPPLYING DEVICE

[75] Inventors: Kimiaki Hayakawa; Noriyoshi Ueda, both of Yokohama; Masakazu Hiroi, Tokyo, all of Japan

[73] Assignee: Canon Kabushiki Kaisha, Tokyo, Japan

[21] Appl. No.: 296,876

[22] Filed: Jan. 12, 1989

Related U.S. Application Data

[63] Continuation of Ser. No. 204,917, Jun. 9, 1988, abandoned, which is a continuation of Ser. No. 869,447, May 27, 1986, abandoned, which is a continuation of Ser. No. 516,440, Jul. 22, 1983, abandoned.

[30] Foreign Application Priority Data

| | | | |
|---|---|---|---|
| Jul. 28, 1982 | [JP] | Japan | 57-131751 |
| Jul. 28, 1982 | [JP] | Japan | 57-131752 |
| Jul. 28, 1982 | [JP] | Japan | 57-131753 |
| Aug. 23, 1982 | [JP] | Japan | 57-145816 |
| Sep. 22, 1982 | [JP] | Japan | 57-165747 |

[51] Int. Cl.[4] ..... B65H 5/00; B65H 3/04

[52] U.S. Cl. ..... 271/10; 271/34; 271/110; 271/113; 271/121; 271/258; 271/275

[58] Field of Search ..... 271/10, 34, 35, 38, 271/110, 111, 113, 114, 116, 121, 122, 126, 118, 258, 259, 275

[56] References Cited

U.S. PATENT DOCUMENTS

| | | | |
|---|---|---|---|
| 1,264,053 | 4/1918 | Garner | 271/38 |
| 1,603,356 | 10/1926 | Rader | 271/38 |
| 3,485,489 | 12/1969 | Lindquist | 271/34 |
| 3,747,918 | 7/1973 | Margulis et al. | 271/275 |
| 3,829,083 | 8/1974 | Shiina et al. | 271/4 |
| 3,948,510 | 4/1976 | Iwamoto et al. | 271/110 |
| 3,949,979 | 4/1976 | Taylor et al. | 271/35 |
| 4,025,066 | 5/1977 | Sue | 271/118 |
| 4,381,860 | 5/1983 | Silverberg | 271/122 |
| 4,589,650 | 5/1986 | Miyoshi | 271/122 X |

*Primary Examiner*—Andres Kashnikow
*Assistant Examiner*—Matthew L. Graham
*Attorney, Agent, or Firm*—Fitzpatrick Cella Harper & Scinto

[57] ABSTRACT

This specification discloses an automatic sheet supplying device for automatically feeding sheets from a sheet supporting table to a predetermined position. More particularly, the specification discloses an automatic sheet supplying device which is provided with a feeding member movable in a sheet feeding direction and a separating member opposed to the feeding member, whereby when sheets fed one by one by the action of the two members arrive at a predetermined position, the two members are caused to be spaced apart from each other to thereby eliminate any load against the sheets being conveyed.

19 Claims, 8 Drawing Sheets

AUTOMATIC SHEET SUPPLYING DEVICE

This application is a continuation of application Ser. No. 07/204,917 filed June 9, 1988, now abandoned, which was a continuation of application Ser. No. 06/869,447 filed May 27, 1986, now abandoned, which was a continuation of application Ser. No. 516,440 filed July 22, 1983, now abandoned.

BACKGROUND OF THE INVENTION

1. Field of the Invention

This invention relates to an automatic sheet supplying device in an image recording apparatus such as an electrophotographic copying apparatus or a reading apparatus. More particularly, it relates to an automatic sheet supplying device which eliminates any load against sheets being conveyed and conveys the sheets without damaging them.

The sheets include originals, recording cards, copy paper or photosensitive paper.

2. Description of the Prior Art

In the automatic sheet supplying device according to the prior art, sheets piled on a sheet supporting table are separated and fed one by one by the cooperation between a paper feed belt moved in the sheet feeding direction of a feeder portion and a separation belt opposed to the paper feed belt and moved in the direction opposite to the direction of movement of the paper feed belt. When a sheet fed arrives at a predetermined position, the driving of the belts is stopped and the sheet is continuedly conveyed by other conveyor means. In this case, however, when the sheet is continuedly conveyed by other conveyor means after the driving of the belts has been stopped, the trailing portion of the sheet is nipped between the two belts. Thus, the nipping force of the belts provides a load which exerts a resistance force on the conveyance of the sheet thereafter, and this obstructs stable conveyance of the sheet.

When unsatisfactory conveyance such as a jam or the like occurs for some reason or other before or upon the arrival of the sheet at a predetermined position, the sheet under such unsatisfactory conveyance is nipped between the two belts. Thus, such sheet is difficult to remove and if an attempt is made to forcibly draw out the sheet, it often damages the sheet. This is particularly a problem in case the sheet is an original.

SUMMARY OF THE INVENTION

It is an object of the present invention to provide an automatic sheet supplying device which ensures stable conveyance of sheets.

It is another object of the present invention to provide an automatic sheet supplying device which enables any jammed sheet to be easily handled.

It is still another object of the present invention to provide an automatic sheet supplying device in which the load during conveyance of sheets is small.

It is yet still another object of the present invention to provide an automatic sheet supplying device in which sheets are not damaged during the conveyance thereof.

It is a further object of the present invention to provide an automatic sheet supplying device in which the load during the conveyance of sheets is reduced to thereby reduce the frequency of occurrence of jam.

The invention will become fully apparent from the following detailed description thereof taken in conjunction with the accompanying drawings.

DESCRIPTION OF THE PREFERRED EMBODIMENTS

The present invention will hereinafter be described in more detail with respect to an embodiment thereof.

The automatic original feeding device of an electrophotographic copying apparatus will hereinafter be described as an embodiment of the present invention. Of course, the present invention is also applicable to other devices than the automatic original feeding device.

Figure 1:
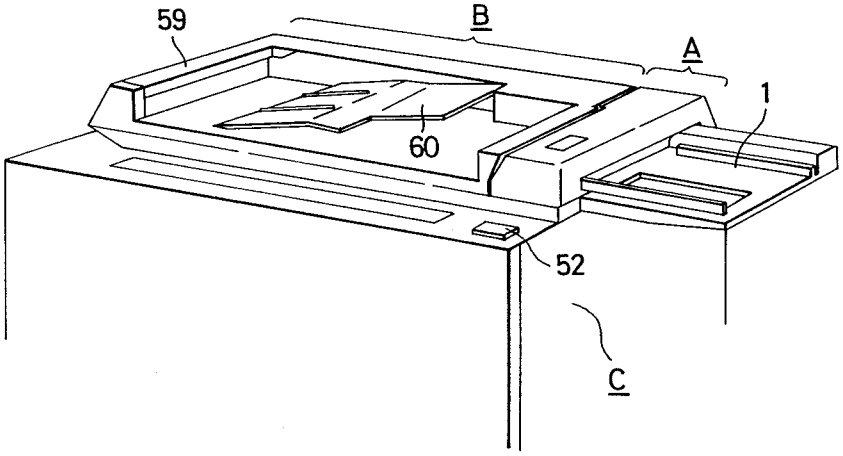
FIG. 1 is a general perspective view of an automatic sheet supplying device provided in an image forming apparatus.
Figure 2:
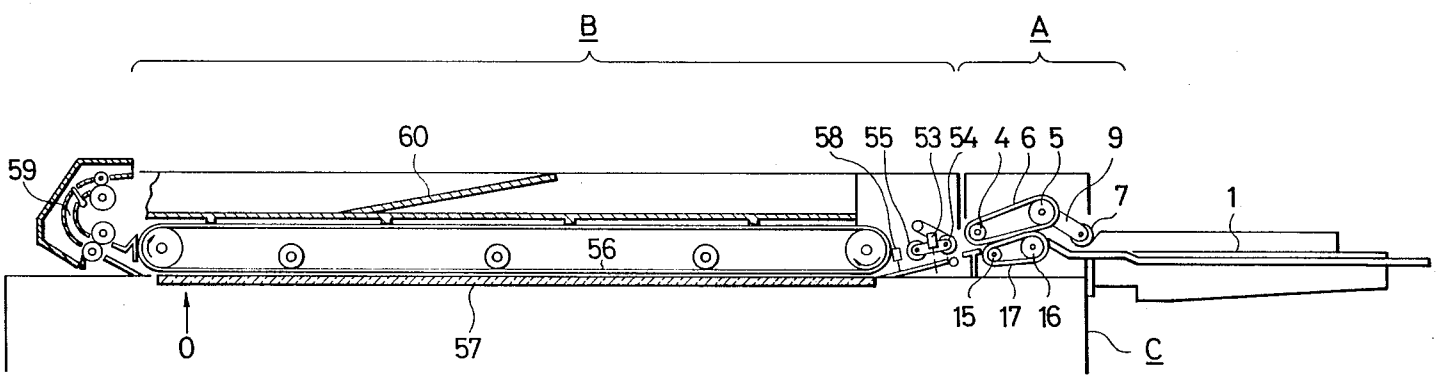
FIG. 2 is a longitudinal cross-sectional view of the device of FIG. 1.

The present invention will hereinafter be specifically described with respect to an automatic sheet supplying device provided as an automatic sheet original feeding device in a copying apparatus. FIG. 1 is a pictorial perspective view of the automatic sheet original feeding device, and FIG. 2 is a longitudinal cross-sectional view thereof. Letter C designates the body of the copying apparatus, and reference numeral 57 denotes a fixed platen (original carriage glass) fit in a window hole formed in the upper surface of the housing of the copying apparatus body. This platen is an original exposure portion. Although not shown, an image forming process mechanism is contained within the housing of the copying apparatus body C.

The automatic sheet original feeding device is disposed above the platen 57 and generally comprises an original feeder portion (original separating and conveying portion) A including an original supporting tray (sheet original supporting table) 1, an original setter portion B, an original reversing portion 59 and a paper discharge tray 60.

The original feeder portion A serves to separate originals set on the original supporting tray 1 with the image-bearing surfaces thereof facing downwardly, one by one from above, and feed them toward the original setter portion B.

The original setter portion B comprises a pick-up roller mechanism connected to the original feeder portion A and an endless conveyor belt 56 in close proximity to or in contact with substantially the entire area of the upper surface of the platen 57, and conveys the originals separated one by one from the original feeder portion A while holding down the originals against the surface of the platen 57 by the belt 56 and causing the originals to slide from right to left on the upper surface of the platen 57 until the leading end edge of each original arrives at a predetermined reference line position O on the platen. That is, the original setter portion B serves to convey the originals to a predetermined position on the platen 57 and set them at such position. Thus, the downwardly facing image-bearing surface of each of the set originals on the platen 57 is exposure processed by exposure means in the copying apparatus body C through the platen 57 which is a transparent plate, whereby copying is executed.

After completion of the copying, the originals on the platen 57 are conveyed in the fashion of U-turn onto the paper discharge tray 60 disposed above the original setter portion by the re-movement of the endless conveyor belt 56 of the original setter portion B and the reversing portion 59 disposed at a subsequent position and are discharged with the image-bearing surfaces thereof facing upwardly.

Thus, the above-described original conveyance cycle is automatically executed for each of the originals supported on the original supporting tray 1 and copying of all of the originals is continuously effected.

The original setter portion B, including the original reversing portion 59 and the paper discharge tray 60, is bodily cockable relative to the platen 57 with the inner part thereof as the fulcrum and, where the original is a book or the like, the original setter portion B is cocked from the platen 57 and the original is placed at a predetermined position on the platen 57, whereafter the original setter portion B is brought down as an original keep plate (pressure plate), and copying is executed in such condition.

Figure 3A:
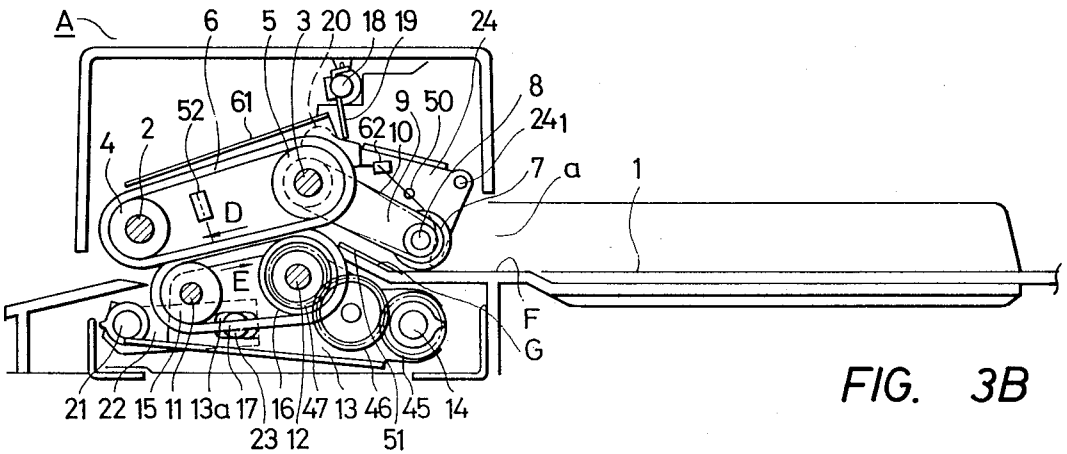
FIGS. 3A and 3B are transverse cross-sectional views of a feeder portion.
Figure 3B:
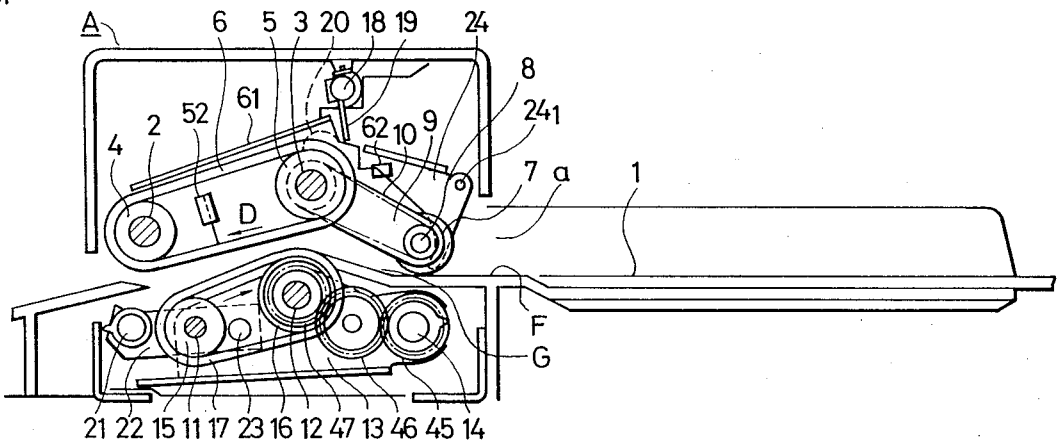

FIGS. 3A and 3B are transverse cross-sectional views of the original feeder portion A. In these Figures, reference numeral 1 designates an original supporting tray, reference numeral 2 denotes a paper feed driving shaft, reference numeral 3 designates a paper feed driven shaft, reference numeral 4 denotes a paper feed driving pulley fixed to the paper feed driving shaft 2, reference numeral 5 designates a paper feed driven pulley fixed to the paper feed driven shaft 3, and reference numeral 6 denotes a paper feed belt passed over the pulleys and 5 and rotatively driven in the direction of arrow D (original conveyance direction). The belt 6 is provided downstream of the original supporting tray 1 with respect to the conveyance direction.

Designated by 7 is a paper feed auxiliary roller fixed to an auxiliary roller shaft 8 and pivotable about the paper feed driven shaft 3 by an auxiliary roller arm 9. The paper feed auxiliary roller 7 is rotated by the rotation of the paper feed driven shaft 3 being transmitted to the shaft 8 by a timing belt 10.

A separation driven shaft 11 and a separation driving shaft 12 are both supported on a separation pivotable plate 13. The separation pivotable plate 13 is pivotable about a pivot shaft 14. Reference numeral 15 designates a separation driven pulley fixed to the separation driven shaft 11, reference numeral 16 denotes a separation driving pulley fixed to the separation driving shaft 12, and reference numeral 17 designates a separation belt passed over the pulleys 15 and 16 and provided downstream of the original supporting tray 1 with respect to the conveyance direction. The separation belt 17 is moved round in the direction of arrow E(the direction opposite to the original conveyance direction). The separation belt 17 and the paper feed belt 6 bear against each other and cooperate with each other to separate and convey the originals one by one.

Reference numeral 18 designates a pick-up actuating shaft, and reference numeral 19 denotes an actuating plate. The auxiliary roller arm 9 is pivoted by pushing the projection 20 of the arm 9 by the actuating plate 19 through rotation of the actuating shaft 18 (see FIG. 6).

Reference numeral 21 designates the actuating shaft of the pivotable plate 13, reference numeral 22 denotes an actuating plate for the pivotable plate, and reference numeral 23 designates a pivotable lever secured to the actuating plate 22. The lever 23 is engaged with the separation pivotable plate 13 through a slot 13*a*, and the separation pivotable plate 13 is pivoted about the shaft 14 by rotation of the actuating shaft 21 of the pivotable plate. In FIG. 3B, the pivotable plate 13 is shown in its downwardly pivoted position.

Reference numeral 24 designates a lever for detecting the presence of originals on the paper feed tray 1 (a lever pivotable about a shaft $24_1$). The lever 24 is adapted to close and open a reed switch 50.

Figure 4:
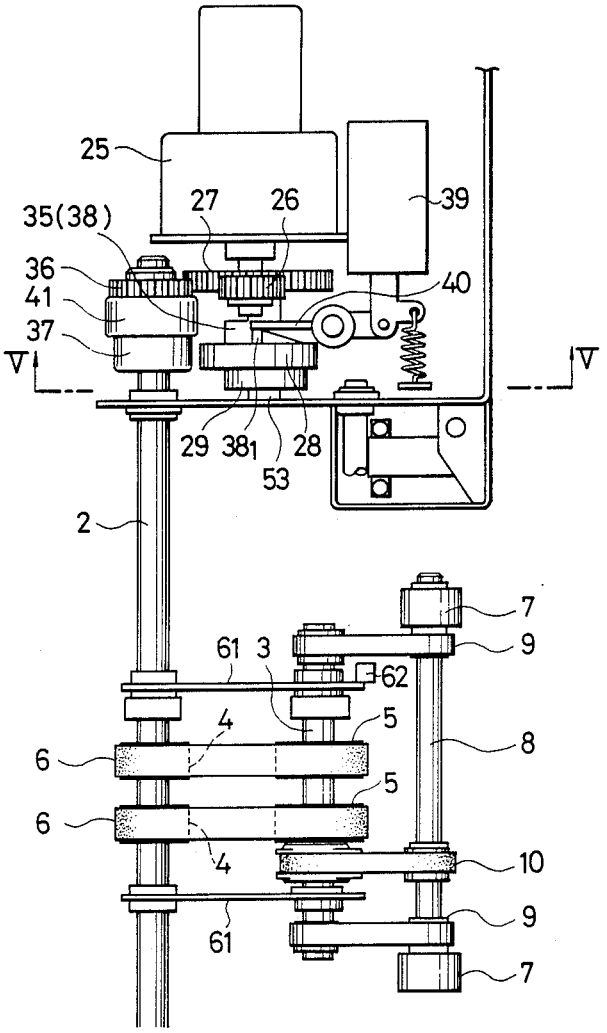
FIG. 4 is a plan view of the mechanism of the feeder portion.
Figure 5:
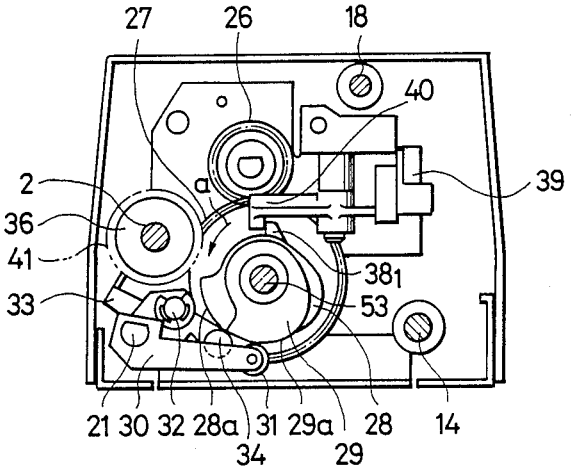
FIG. 5 is a side view of the driving mechanism on the inner side of the feeder portion.
Figure 6:
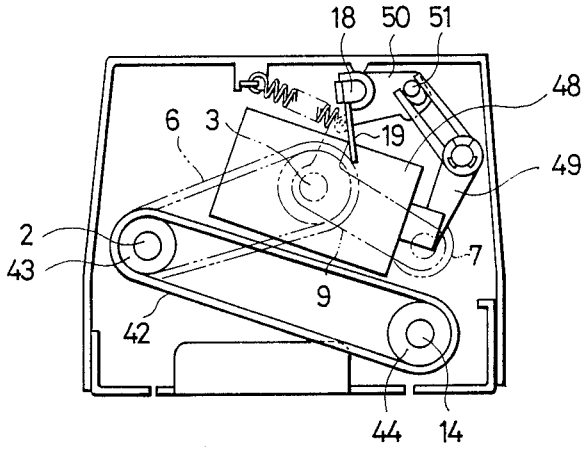
FIG. 6 is a side view of the mechanism on this side of the feeder portion.

FIGS. 4, 5 and 6 show the driving system of the feeder portion A, FIG. 4 being a plan view of the feeder mechanism, FIG. 5 being a cross-sectional view of the inner driving portion of the feeder mechanism (a view taken along the line V—V of Figure 4), and FIG. 6 being a side view of the feeder mechanism portion on this side. In these Figures, reference numeral 25 designates a motor, reference numeral 26 denotes a motor gear, reference numeral 27 designates a cam gear, reference numeral 28 denotes a separating pivotable cam, and reference numeral 29 designates a clutch cam. The drive is transmitted between the cam gear 27 and the clutch cam through a spring clutch 35.

A cam roller 31 supported on the end of a roller arm 30 fixed to the actuating shaft 21 of the pivotable plate (FIGS. 5 and 3) is engaged with the separation pivotable cam 29, and a cam roller 34 supported on the end of a clutch pawl 33 supported on a pawl supporting shaft 32 is engaged with the clutch cam 28.

Designated by 36 is a paper feed gear which is in mesh engagement with the cam gear 27. A spring clutch 37 is provided between the paper feed gear 36 and the paper feed driving shaft 2, and transmission of the drive is controlled by the clutch pawl 33.

A control ring 38 having projections $38_1$ at diametrically opposed (180°) positions is provided on the periphery of the spring clutch 35, and a clutch pawl 40 engaged with a plunger 39 becomes engaged with or disengaged from the projection $38_1$ of the control ring 38 by ON-OFF of the plunger 39, whereby the drive from the cam gear 27 to the cams 28 and 29 is controlled for each half of one full rotation.

A control ring 41 having cut-aways over the entire periphery thereof is provided on the periphery of the spring clutch 37 adjacent to the paper feed gear 36 so that as seen, as the clutch pawl 33 is urged against the control ring 41, the drive from the paper feed gear 36 to the paper feed driving shaft 2 is cut off. What has been described above is the inner driving mechanism portion of the feeder portion A.

In the mechanism on this side of the feeder portion of FIG. 6, reference numeral 42 designates a timing belt passed over a pulley 43 fixed to the paper feed driving shaft 2 and a pulley 44 fixed to the pivot shaft 14, and rotation of the paper feed driving shaft 2 is transmitted to the pivot shaft 14. As shown in FIG. 3, the pivot shaft 14 and the separation driving shaft 12 are connected together by a separation gear train 45, 46, 47 and rotation of the pivot shaft 14 is transmitted to the separation driving shaft 12.

Designated by 48 (FIG. 6) is a pick-up plunger. A pick-up actuating arm 49 is engaged with a pin 51 fixed to the end of a pick-up pivotable plate 50 fixed to the pick-up actuating shaft 18, and by ON-OFF of the plunger 48, the pick-up actuating shaft 18 is rotated to move the auxiliary roller arm 9 (FIGS. 2–4) up and down.

The configuration of the original supporting tray 1 will now be described. A portion F(FIG. 3) on which originals are actually supported is horizontal and a portion G just before an original moves into between the paper feed and separation belts 6 and 17 is inclined relative to the horizontal portion F. By attaching a material of great friction coefficient (such as rubber 51) to the portion G, rough separation is made possible in advance before an original is fed into between the belts 6 and 17. Also, the belts 6, 17 and the portion G being angled is for the purpose of increasing the rigidity of the next original relative to an original separated when the separation belt 17 pivots downwardly due to the pivotal movement of the pivotable plate 13 about the shaft 14 and thereby preventing the next original from being fed with the preceding original. The portion F is made horizontal to maintain such effect. This is because if the portion F is also inclined, paper will float due to its rigidity between the portions F and G and the above-described effect will not be provided. That is, the tray 1 is configured as described above for the three reasons set forth above, i.e., the preliminary separation of originals, the prevention of the next original from being fed with the preceding original and the maintenance of the aforementioned effect.

Operation of the present embodiment will now be described. When a bundle of originals is placed on the original supporting tray 1 with the image-bearing surfaces of the originals to be copied facing downwardly and the leading edge side of the bundle of originals is directed into the original intake port a of the feeder portion A, the leading edge of the bundle of originals pushes the lever 24, whereby the lever 24 pivots clockwisely about the shaft $24_1$. Thereby the reed switch 50 is closed and it is detected that the originals have been set on the tray 1. When a copy start button 52 is then depressed, the plunger 48 (FIG. 6) is energized in response to a copy signal produced thereby and the pick-up actuating shaft 18 rotates counter-clockwisely, whereby the auxiliary roller 7 pivots clockwisely from gravity and is urged against the upper surface of the leading edge of the bundle of originals. Thereafter, the motor 25 (FIG. 4) starts to revolve. When the plunger 39 is then energized in response to a signal, the clutch pawl 40 operates and becomes disengaged from one projection $38_1$ of the control ring 38 of the spring clutch 35, whereby the cams 28 and 29 are rotated by 180° in counter-clockwise direction (the direction of arrow a) at a time, whereafter the clutch pawl 40 becomes engaged with the other projection (not shown) of the control ring 38 to thereby stop the cams 28 and 29.

With the 180° rotation of the cams 28 and 29, the rollers 31 and 34 engaged with these cams are operated. First, the roller 31 is moved upwardly in accordance with the shape of the cam 29. Thereby the pivotable plate 13 is pushed up and the separation belt 17 rises to an original separating position. Subsequently, the roller 34 is moved upwardly in accordance with the shape of the cam 28. Thereby the clutch pawl 33 is disengaged from the control ring 41 of the spring clutch 37 on the paper feed driving shaft 2 side and the paper feed driving shaft 2 starts to rotate.

That is, the cams 28 and 29 start to rotate in the direction of arrow a from their positions shown in FIG. 5. Thereupon, the roller 31 engaged with the cam 29 moves upwardly along the outer periphery of the cam 29 with the passage of the arcuate portion 29*a* of the cam 29. Thereby the roller arm 30 is pivoted counter-clockwisely, so that the actuating shaft 21 secured to the arm 30 is also rotated counter-clockwisely. Thereupon, the actuating plate 22 secured to the shaft 21 pivots counter-clockwisely to cause the pivotable plate 13 to pivot clockwisely about the shaft 14 through the lever 23. Thus, the separation belt 17 bears against the paper feed belt 6 and becomes operative.

Then the arcuate portion 28*a* of the cam 28 passes by the roller 34, so that the roller 34 moves upwardly along the outer periphery of the cam 28. Thus, the clutch pawl 33 pivots counter-clockwisely about the pivot shaft 32 and therefore becomes disengaged from the control ring 41 of the spring clutch 37 to permit the paper feed driving shaft 2 to start rotating. Accordingly, the paper feed belt 6 and the separation belt 17 start to move round in the opposite directions.

In the present embodiment, the arcuate portion 28*a* of the cam 28 has a longer circumferential length than the arcuate portion 29*a* of the cam 29 (the angle of opening relative to the opposite ends of the arcuate portion 29*a* with the middle of the cam shaft 53 as the center is about 60°, whereas the angle of opening relative to the opposite ends of the arcuate portion 28*a* is about 180°) and therefore, the belts 6 and 17 start moving round after they have positively borne against each other. Also, as will later be described, the belt 17 separates from the belt 6 after their movement has been stopped.

Now, as regards the originals on the tray 1, the feeding-out force of the auxiliary roller 7 acts on the uppermost surface of the originals, whereby the uppermost original is separated in advance on the portion G of the tray 1 and further, the originals are separated one by one between the paper feed belt 6 and the separation belt 17 and after all, only the uppermost original is fed out When the leading edge of the separated original is detected by a sensor 52 (FIG. 3) disposed between the paper feed driving shaft 3 and the paper feed driven shaft 3, a detection signal is produced and the plunger 48 (FIG. 6) is deenergized and the auxiliary roller 7 moves upwardly. The original feeding by this auxiliary roller 7 is stopped at this point of time, but the uppermost original is continuously fed toward the setter portion B by movement of the paper feed belt 6.

When the leading edge of the original is detected by an entrance sensor 53 (FIG. 2) on the setter B side, a detection signal is further produced and the plunger 39 is deenergized with respect to the feeder portion A. The clutch pawl 40 then becomes disengaged from the projection $38_1$ of the control ring 38 of the spring clutch 35 and the cams 28 and 29 again rotate by 180°. With rotation of the cams 28 and 29, the roller 34 lowers and the pawl 33 is urged against the control ring 41 of the spring clutch 37 on the paper feed driving shaft 2 side, whereupon the clutch 37 is disengaged and rotation of the paper feed driving shaft 2 is stopped. Subsequently, the roller 31 lowers and the pivotable plate 13 is lowered about the shaft 14 by rotation of the shaft 21. Accordingly, the separation belt 17 is lowered away from the paper feed belt 6 and a gap is provided between the belts 6 and 17, so that the trailing edge of the separated original assumes a free state (a load-free state). That is, the original separated from the feeder portion A and conveyed to the setter portion B is stopped from the conveyance by the feeder portion A at a point of time whereat the leading edge thereof has slightly entered the entrance of the setter portion B and has been detected by the sensor 53, and is temporally stopped from being fed with the leading edge thereof positioned at the sensor 53. When this temporary stoppage of the original occurs, a pick-up roller 54 at the entrance of the setter portion B is lowered in response to the detection signal by a mechanism, not shown, to hold down the original. Thereafter, a conveyor roller 55 and a conveyor belt 56 start to rotate and the original is conveyed from right to left on the platen 57 without being subjected to the load by the belts 6 and 17. When the leading edge of the original arrives at the reference position O on the left of the platen 57, the rotation of the roller 55 and belt 56 is stopped at that point of time. This stoppage of the rotation of the roller 55 and belt 56 is accomplished by counting a clock (not shown) contained in the setter portion after an original leading edge sensor 58 has detected the leading edge of the original. In this clock, by detecting the leading edge and trailing edge of the original by the leading edge sensor 58, it is possible to detect the length on the original in terms of the clock number in the meantime. By detecting the size of the original in terms of this length and supplying the detection signal to the copying apparatus body C, a transfer paper cassette on the body side can be selected so that copying is effected on transfer paper of a size corresponding to the size of the original.

Thus, the original is automatically set at a predetermined position on the platen 57 with its image-bearing surface facing downwardly. When the original arrives at the reference position on the platen 57 and is stopped thereat, copying operation is started on the copying apparatus body C side. That is, the downwardly facing image-bearing surface of the set original is exposure-processed by exposure means (not shown) in the copying apparatus body C through the platen 57 which is a transparent plate and thus, copying (single or multiple) is executed.

Also, when the original is stopped at the reference position O on the platen 57 as described above, the plunger 39 is energized in response to this signal and the belt 17 bears against the belt 6 and thus, the feeder portion A enters its separating and conveying operation with respect to the next original on the tray 1, and said next original stands by with its leading edge stopped at a position whereat it has been detected by the entrance sensor 53 of the setter portion.

When copying operation is terminated, the belt 56 and the conveyor roller 55 again begin to rotate in response to the copying termination signal, and the original having been copied passes through the original reversing portion 59 and is discharged onto the paper discharge tray 60. Simultaneously therewith, the next original standing by at the position of the sensor 53 is conveyed onto the platen 57 and thereafter, the same operation as described above is repeated.

Description will now be made of the condition in which an original jams when the paper feed belt 6 and the separation belt 17 are moving round, that is, when the separating operation is being effected. Paper jam is detected by the delay of paper to the entrance sensor 53 and, when paper jam is detected thereby, the plunger 39 is immediately deenergized in response to the jam signal. Thereupon, as previously described, the cams 28 and 29 make one half rotation, whereby the drive to the paper feed driving shaft 2 is cut off and the pivotable plate 13 is lowered. Thereby the belt 17 becomes spaced apart from the belt 6 and the original becomes free between the belts 6 and 17. Accordingly, removal of the jammed original can be accomplished easily.

Figure 7:
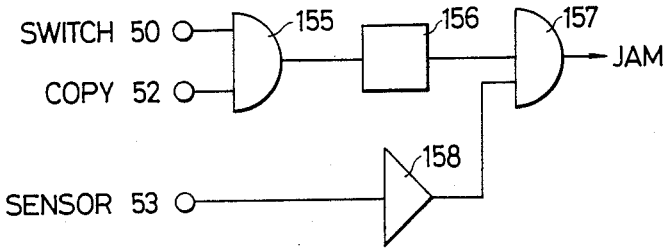
FIG. 7 is a circuit diagram showing an embodiment of jam detecting means.

An example of the jam detecting means is shown in FIG. 7. In FIG. 7, reference numerals 155 and 157 designate AND gates, reference numeral 156 denotes a timer, and reference numeral 158 designates an inverter. The present embodiment is such that it is detected by a switch 50 that originals are piled on the tray 1 and, when a copy button 52 is depressed, the timer 156 starts to operate and it produces a jam signal if the sensor 53 does not detect the arrival of an original within a predetermined time.

In the apparatus of this type, as previously described, the originals piled on the original supporting tray 1 are separated one by one by the feeder portion A and enter the setter portion B and, when an original is conveyed to a predetermined position on the platen 57 by the conveyance driving means 55 and 57 of the setter portion B, the portion of the original which has not yet passed through the feeder portion A is nipped between the paper feed belt 6 and the separation belt 17 of the feeder portion A which have already been stopped. Therefore, when the original is conveyed to the predetermined position on the platen 57 by the conveyance driving means 55 and 57 of the setter portion B, an original conveyance load, i.e., a resistance force, occurs to render the conveyance of the original unstable.

However, in the aforedescribed embodiment of the present invention, after the originals on the original supporting tray 1 have been separated one by one by the feeder portion A and have entered the setter portion B, the paper feed belt 6 and the separation belt 17 of the feeder portion A are caused to be spaced apart from each other to thereby release the nipping of an original therebetween and therefore, said load against the original is eliminated and accordingly, the original conveyance by the conveyance driving means 55 and 57 of the setter portion B can be accomplished stably and reliably.

A further embodiment will hereinafter be described. In the present embodiment, the spacing apart of the belts is accomplished by a plunger instead of a cam mechanism.

Description will hereinafter be made by reference to FIGS. 8 to 12.

Figure 8:
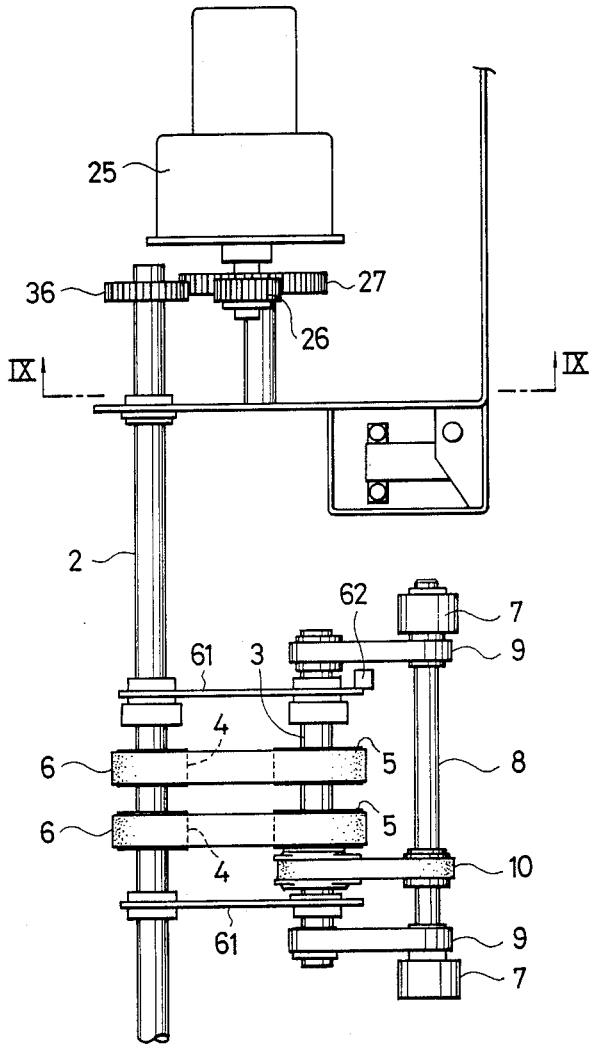
FIG. 8 is a plan view of another embodiment of the feeder portion.
Figure 9:
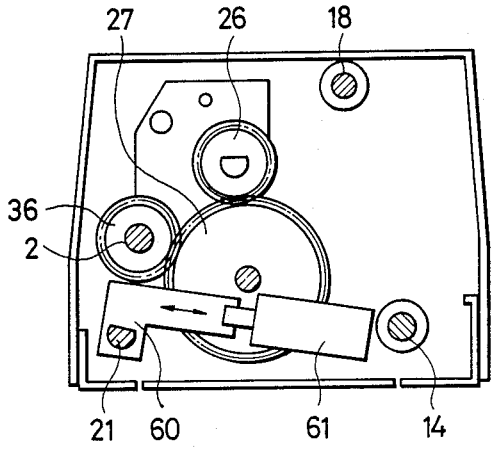
FIG. 9 is a side view of the driving mechanism of still another embodiment of the feeder portion.

FIGS. 8 and 9 show the driving system of the feeder portion A of the present embodiment, FIG. 8 being a plan view of the feeder mechanism and FIG. 9 being a cross-sectional view of the driving portion of the mechanism on the inner side thereof (a view taken along the line IX—IX of FIG. 8). In these Figures, reference numeral 25 designates a motor, reference numeral 26 denotes a motor gear, and reference numeral 27 designates an idler gear.

A pivotable plunger arm 60 fixed to a pivotable plate actuating shaft 21 (FIG. 9) actuates the pivotable plate actuating shaft 21 by ON-OFF of a pivotable plunger 61 and causes a pivotable actuating plate 13 to pivot.

Designated by 36 is a paper feed gear which is in mesh engagement with the idler gear 27 to transmit the drive from the motor 25 to the paper feed driving shaft 2. What has been described above is the driving mechanism of the feeder portion A on the inner side thereof.

Now, when the leading edge of an original fed from the tray 1 is detected by the original sensor 53 (FIG. 2) on the setter B side as described previously, the drive of the motor is stopped in response to this detection signal. Thus, rotation of the paper feed driving shaft 2 is stopped and then, in response to a signal, the pivotable plunger 61 (FIG. 9) is energized and by rotation of the shaft 21, the pivotable plate 13 is lowered about the shaft 14. Accordingly, the separation belt 17 lowers away from the paper feed belt 6 side from gravity and a gap is formed between the belt 6 and the belt 17 and thus, the trailing edge of the original separated becomes free (free of any load) and the original is conveyed in a load-free state by the rotational force of rollers 54 and 55 or belt 56.

When the trailing edge of the original is then detected by the original sensor 53, the pivotable plunger 61 is deenergized in response to this detection signal and the separation belt 17 moves up to bear against the belt 6 and becomes capable of separating the next original and, when the preceding original is stopped at the reference position O on the platen 57 as described above, the feeder portion A enters its separating and conveying operation for the next original which stands by while being stopped at a position whereat the leading edge thereof has been detected by the entrance sensor 53 of the setter portion.

When copying operation is terminated, the belt 56 and conveyor roller 55 again begin to rotate and the original having been copied passes through the original reversing portion 59 and is discharged onto the paper discharge tray 60. Simultaneously therewith, the next original standing by at the position of the sensor 53 is conveyed onto the platen 57 and thereafter, the same operation as described above is repeated.

Figure 11:
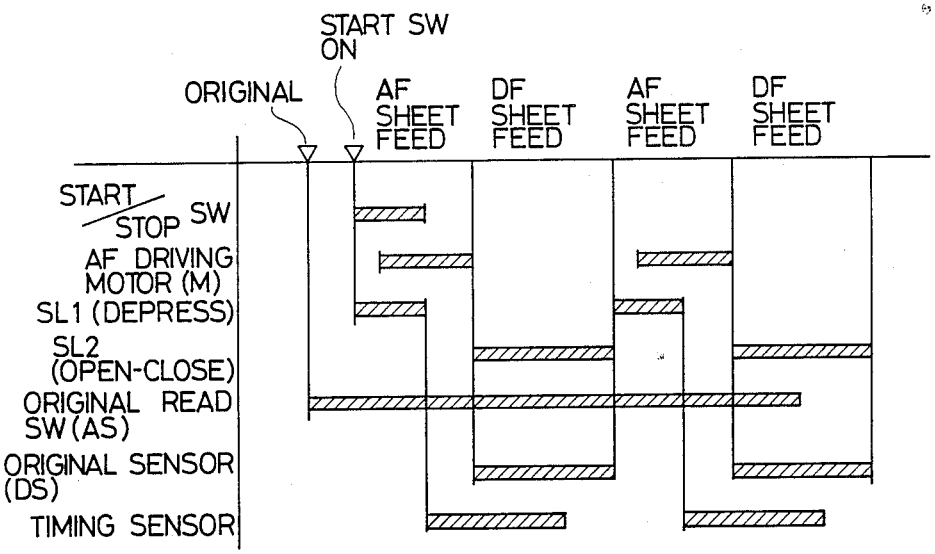
FIG. 11 is a timing chart.
Figure 10:
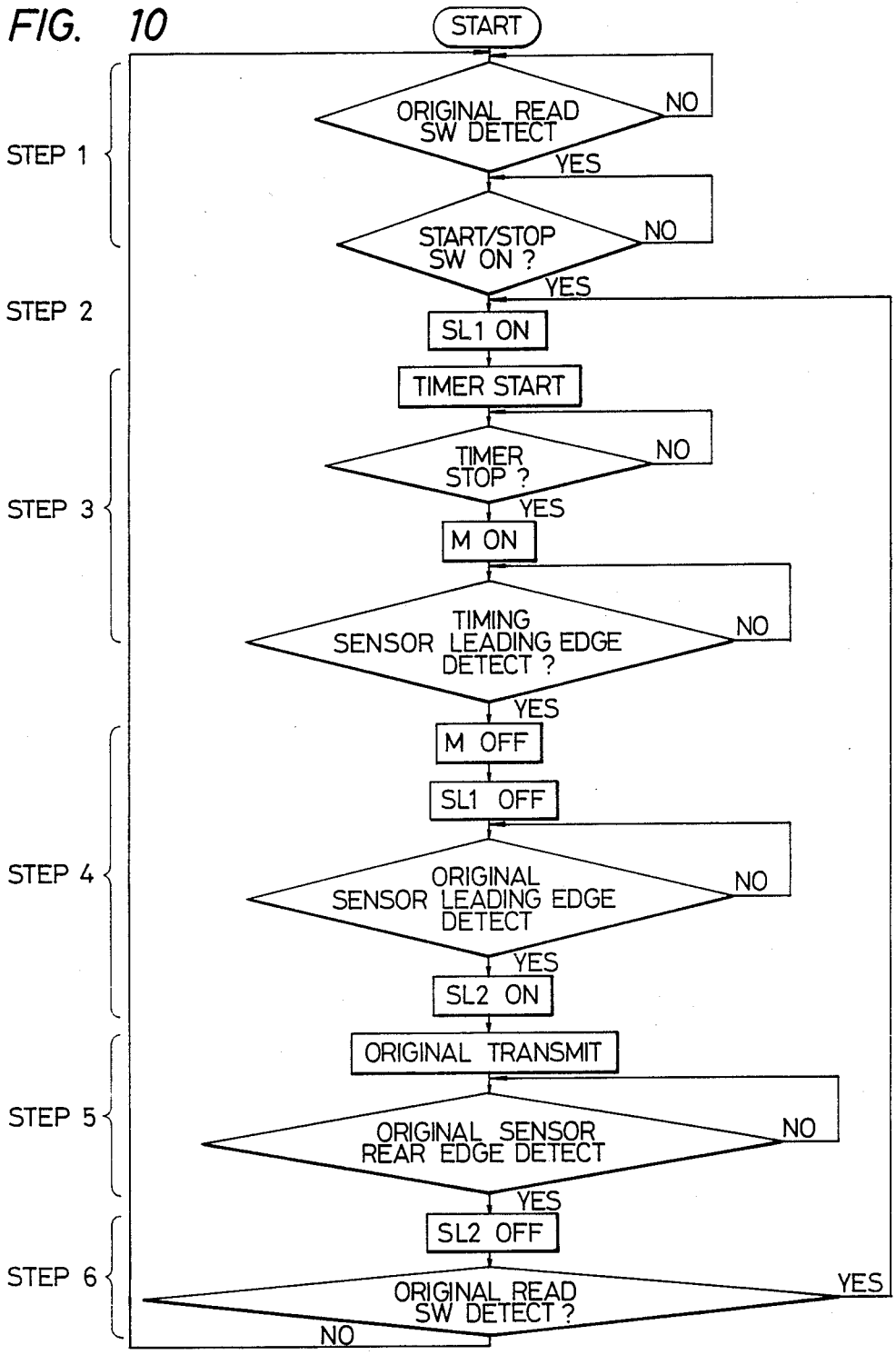
FIG. 10 is a program flow chart.
Figure 12:
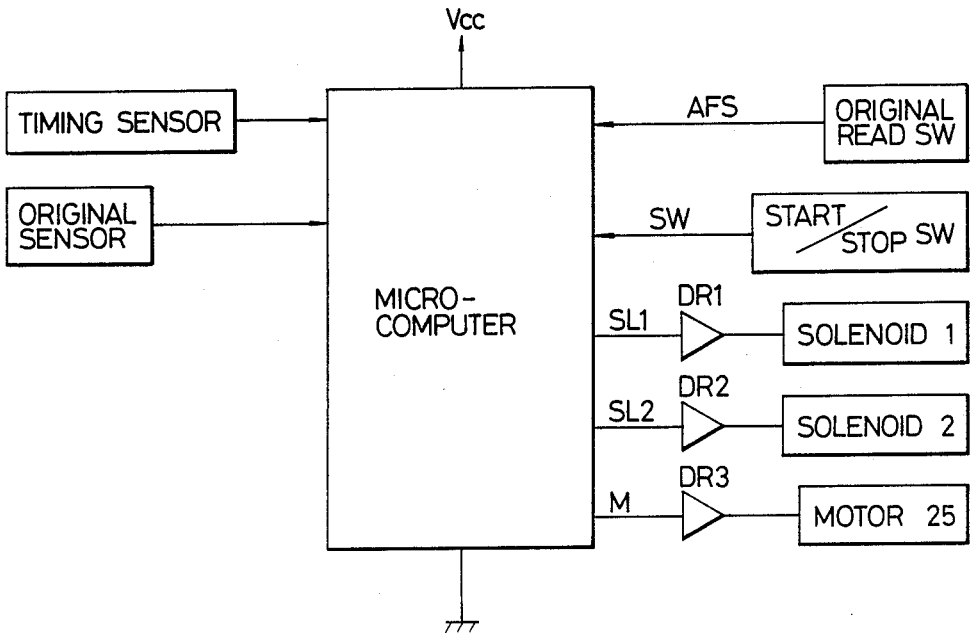
FIG. 12 is a block diagram of a control circuit.

FIG. 10 is a program flow chart of the operation of each portion, FIG. 11 is a timing chart, and FIG. 12 is a block diagram of the control circuit.

At step 1, whether original feeding should be started is judged. That is, whether originals are piled on the paper feed tray 1 and further, whether a start switch is in its ON position is read from signals AFS and SW being applied as inputs to CPU for AF control (FIG. 12) and is repeatedly checked up until the start switch is closed.

When the start switch is closed, the program proceeds to step 2, at which the solenoid 1 is energized by a plunger driving signal SL1 to lower the original keep roller 7, and then the program proceeds to step 3.

At step 3, a timer for counting about 0.4 second is started, whereafter the motor 25 is energized by a motor drive control signal M to start original feeding. The program waits until a timing sensor detects the leading edge of an original and, when such detection is read in, the program proceeds to step 4.

After the motor 25 is stopped at step 4, the solenoid 1 is deenergized to permit the original keep roller to be moved up. Further, the program waits until the original sensor 53 detects the leading edge of the original and, when the leading edge of the original is read in, the solenoid 2 is energized to open the separation belt 17.

At step 5, original conveyance is started and the program waits until the original sensor 53 detects the trailing edge of the original and, when such detection is read in, the program proceeds to step 6.

At step 6, the solenoid 2 is deenergized to close the separation belt 17 and again, the presence or absence of originals on the paper feed tray 1 is judged. When originals are present on the tray 1, the program returns to step 2 and, when originals are absent on the tray 1, the program returns to step 1.

Description will now be made of a condition in which paper jam has occurred when the paper feed belt 6 and the separation belt 17 are moving round, that is, when the separating operation is being effected. Paper jam is detected by the delay of an original to the entrance sensor 53 and, when paper jam is detected, the motor 25 is stopped to thereby stop the paper feed driving shaft 2 and the plunger 61 is immediately energized and the pivotable plate 13 lowers from gravity. Thus, the original becomes free between the belts 6 and 17 and therefore, the jammed original can be easily removed.

As described above, in the present embodiment, once the originals on the original supporting tray 1 have been separated one by one by the feeder portion A and entered the setter portion B, the paper feed belt 6 and the separation belt 17 of the feeder portion A are caused to be spaced apart from each other to release the nipping of the original therebetween and therefore, said load against the original is eliminated and accordingly, the original conveyance by the conveyance driving means 55 and 57 of the setter portion B can be accomplished stably and reliable.

The aforedescribed embodiment has been shown as an example in which the separation belt 17 is pivoted downwardly relative to the paper feed belt 6 to thereby space the two belts apart from each other, whereas this is not restrictive, but the paper feed belt 6 may be pivoted upwardly relative to the separation belt 17 to thereby space the two belts apart from each other. The means for spacing the two belts apart from each other is not restricted to the pivotal movement, but the whole of the two belts may be moved vertically by the use of a link mechanism or the like. Also, in the present embodiment, two belts moved round in opposed relationship with each other have been shown as the means for separating and conveying originals one by one, whereas the present invention is not restricted thereto, but use may also be made of a pair of rollers rotatable in opposite directions or of course, a combination of a roller rotatable in the sheet feeding direction and a friction piece bearing against such roller is also applicable. Accordingly, the rotating members are not restricted to belts, but may be, for example, circular rollers or square rollers. Also, the separating member includes a belt, a roller or a friction piece. In the present invention, the timing at which the rotational member and the separating member are spaced apart from each other is at least after a sheet has obtained the conveyance force by other conveyor means and therefore, the predetermined position in which the spacing means operates is a position at least after a sheet has obtained the conveyance force by other conveyor means.

What we claim is:

1. An automatic sheet supplying device comprising:

a sheet supporting table for supporting sheets thereon;

a rotatable member provided downstream of said sheet supporting table with respect to a direction of conveyance and rotatable in a sheet feeding direction;

a separating member provided in opposed relationship with said rotatable member;

spacing means for spacing said rotatable member and said separating member apart from each other when a sheet arrives at a predetermined position;

cam means for controlling rotation of said rotatable member;

cam means for controlling the operation of said spacing means; and control means for controlling the operations of said two cam means at a time.

2. An automatic sheet supplying device according to claim 1, wherein said rotatable member is a paper feed belt moved in the direction of conveyance.

3. An automatic sheet supplying device according to claim 1, wherein said separating member is a separation belt moved in the direction opposite to the direction of conveyance.

4. An automatic sheet supplying device according to claim 1, wherein said rotatable member and said separating member bear against each other.

5. An automatic sheet original supplying apparatus comprising:

a sheet original supporting table for supporting sheet originals thereon;

a rotatable member provided downstream of said sheet original supporting table with respect to a direction of sheet original conveyance, and rotatable in a sheet original feed direction, a separating member provided in opposed relationship with said rotatable member for cooperating therewith to separate sheet originals one by one;

control means for temporarily stopping said sheet originals when the leading edge of said sheet original reaches the position between a point at which said rotatable member and said separating member oppose each other and an original image reading position;

spacing means for spacing said rotatable member and said separating member apart from each other while the sheet original is temporarily stopped by the operation of said control means;

conveying means for conveying each sheet original separated and fed one by one by cooperation of said rotatable member and said separating member downstream towards the original image reading position;

original transport means for transporting said sheet original to the original image reading position and for stopping it thereat;

said control means controlling the conveying means to cause the sheet original to move towards the original image reading position after said rotatable member and said separating member are spaced apart from each other and also after a preceding sheet original starts to be discharged from the original reading position by said original transport means.

6. An automatic sheet original supplying apparatus comprising:

a sheet original feeder portion having a sheet original supporting table for supporting sheet originals thereon, a rotatable member provided downstream of said sheet original supporting table with respect to a direction of sheet original conveyance and rotatable in a sheet original feeding direction, a separating member provided in opposed relationship with said rotatable member for cooperating therewith to separate sheet originals one by one, and a first sheet path for leading said separated original;

a sheet original setter portion having a second sheet path for leading said led original and conveying means for conveying the sheet original fed from said sheet original feeder portion to an original image reading position, said sheet original setter portion being capable of opening and closing relative to said original image reading position about an axis parallel to an original conveying direction for positioning a booktype original on the original image reading position; and spacing means for spacing said rotatable member and said separating member apart from each other after the leading edge of said sheet original has arrived at said sheet original setter portion.

7. An automatic sheet original supplying apparatus comprising:

a sheet original supporting table disposed substantially horizontally for supporting a bundle of sheet originals manually mounted thereon;

a rotatable member provided downstream of said sheet original supporting table with respect to a direction of sheet original conveyance and for feeding a sheet original from said sheet original supporting table;

a separating member provided in opposed relationship with said rotatable member for cooperating therewith to separate sheet originals one by one;

spacing means for spacing said rotatable member and said separating member apart from each other;

inclined sheet original guide means provided just before an opposing position of said rotatable member and said separating member within a sheet original conveyance path from said sheet original supporting table to said opposing position, and inclined upwards gradually with respect to the sheet conveyance direction;

means for forcing the sheet originals through said inclined sheet original guide means to the opposing position of the rotatable member and the separating member, said means descending from an upper position according to a sheet supplying signal to operate on the sheet originals;

original transport means for transporting said separated sheet originals to an original image reading position and for stopping it thereat; and control means for controlling the original transport means to transport said separated sheets after said rotatable member and said separating member are spaced apart from each other and also after a preceding sheet original starts to be discharged from the original image reading position by said original transport means.

8. An image forming apparatus comprising:

an original image reading position for reading an original image, provided on an image forming apparatus body;

a sheet original supporting table for supporting sheet originals to be fed to said original image reading position;

a rotatable member provided downstream of said sheet original supporting table with respect to a direction of sheet original conveyance, and rotatable in a sheet original feeding direction;

a separating member provided in opposed relationship with said rotatable member for cooperating therewith to separate sheet originals one by one;

control means for temporarily stopping said sheet original when the leading edge of said sheet original reaches between the position where said rotatable member and said separating member oppose each other and the original image reading position;

spacing means for spacing said rotatable member and said separating member apart from each other while the sheet original is temporarily stopped by the operation of said control means;

conveying means for conveying the sheet original separated and fed one by one by cooperation of said rotatable member and said separating member downstream towards the original image reading position;

original transport means for transporting said sheet original to the original image reading position and for stopping it thereat; and said control means controlling the conveying means to make the sheet original move towards the original image reading position after said rotatable member and said separating member are spaced apart from each other and also after a preceding sheet original starts to be discharged from the original reading position by said original transport means.

9. An image forming apparatus comprising an original image position for reading an original image provided on an image forming apparatus body;

a sheet original feeder portion having an original sheet supporting table for supporting sheet originals to be fed to said original image reading portion, a rotatable member provided downstream of said sheet original supporting table with respect to a direction of sheet original conveyance and rotatable in a sheet original feeding direction, a separating member provided in opposed relationship with said rotatable member for cooperating therewith to separate sheet originals one by one, and a first sheet path for leading said separated original;

a sheet original setter portion having a second sheet path for leading said led original and conveying means for conveying the sheet original feed from said sheet original feeder portion to the original image reading position, said sheet original setter portion being capable of opening and closing relative to said original image reading position about an axis parallel to an original conveying direction for positioning a booktype original on the original image reading position; and spacing means for spacing said rotatable member and said separating member apart from each other after the leading edge of said sheet original has arrived at said sheet original setter portion.

10. An apparatus according to claim 5, 6, 7, 8 or 9, wherein said rotatable member is a feed belt reeved on pulleys.

11. An apparatus according to claim 5, 6, 7, 8 or 9, wherein said separating member is a separating belt reeved on pulleys, and is rotated in a direction opposite to the sheet original conveyance direction.

12. An apparatus according to claim 5, 5, 8 or 9, wherein a platen which the original contacts is located at said original image reading position, and said conveying means is a conveying belt opposed to substantially the entire area of the platen in close proximity or in contact with the upper surface of the platen.

13. An apparatus according to claim 5, 6, 8 or 9, wherein said conveying means stops upon reading the original image.

14. An apparatus according to claim 5, 6, 8 or 9, wherein said conveying means comprises a roller capable of moving upwards and downwards.

15. An apparatus according to claim 6 or 9, wherein said setter portion comprises a discharge tray receiving the read sheet original.

16. An apparatus according to claim 5, 6, 7, 8 or 9, wherein said rotatable member stops rotating before being spaced apart from said separating member.

17. An apparatus according to claim 7, wherein said guide means comprises a friction member.

18. An automatic sheet original supplying apparatus comprising:

a sheet original supporting table disposed substantially horizontally for supporting a bundle of sheet originals manually mounted thereon;

a rotatable member provided downstream of said sheet original supporting table with respect to a direction of sheet original conveyance, and rotatable in a sheet original feeding direction;

a separating member provided in opposed relationship with said rotatable member for cooperating therewith to separate sheet originals one by one;

inclined sheet original guide means provided just before an opposing position of said rotatable member and separating member within a sheet original conveyance path from said sheet original supporting table to said opposing position, and inclined upwards gradually with respect to the sheet conveyance direction;

means for forcing the sheet original through said inclined sheet original guide means to the opposing position of the rotatable member and the separating member, said means descending from an upper position according to a sheet supplying signal to operate onto the sheet originals;

contactable/separable conveying means normally disposed in an ascended awaiting position for conveying each sheet original separated and fed one by one by cooperation of said rotatable member and said separating member downstream towards an original image reading position;

detecting means for detecting the sheet original having reached a position of said conveying means;

original transporting means for transporting said sheet original to the original image reading position and for stopping it thereat;

control means for temporarily stopping said fed sheet original when the leading edge of said sheet original reaches the detecting means; and spacing means for spacing said rotatable member and said separating member apart from each other while the sheet original is temporarily stopped by the operation of said control means;

said control means controlling the conveying means so as to contact with said sheet original to cause the sheet original to move towards the original image reading position after said rotatable member and said separating member are spaced apart from each other and after the preceding sheet original starts to be discharged from the original image reading position by said original transporting means.

19. An automatic sheet original supplying apparatus according to claim 7 or 18, further including detecting means for detecting that the leading edge of the sheet original reaches to the opposing position, said detecting means causing said forcing means to ascend for retraction upon reaching of the leading edge of the sheet original to the opposing position.

* * * * *

UNITED STATES PATENT AND TRADEMARK OFFICE

CERTIFICATE OF CORRECTION

PATENT NO. : 4,850,581

DATED : July 25, 1989

INVENTOR(S) : KIMIAKI HAYAKAWA, ET AL.

It is certified that error appears in the above-identified patent and that said Letters Patent is hereby corrected as shown below:

COLUMN 3

Line 8, "exposure" should read --exposure- --.

COLUMN 4

Line 31, "separating" should read --separation--.
Line 40, "clutch cam 28." should read --clutch cam 29.--.

COLUMN 6

Line 45, "out" should read --out.--.
Line 47, "paper feed driving shaft 3" should read --paper feed driving shaft 2--.

COLUMN 7

Line 9, "temporally" should read --temporarily--.

COLUMN 10

Line 28, "reliable." should read --reliably.--.

COLUMN 11

Line 32, "originals" should read --original--.

UNITED STATES PATENT AND TRADEMARK OFFICE

CERTIFICATE OF CORRECTION

PATENT NO. : 4,850,581

DATED : July 25, 1989

INVENTOR(S) : KIMIAKI HAYAKAWA, ET AL.

It is certified that error appears in the above-identified patent and that said Letters Patent is hereby corrected as shown below:

COLUMN 12

Line 4, "original" should read --original,--.
Line 39, "originals" should read --original--.

COLUMN 13

Lines 30-31, "portion," should read --position,--.
Line 60, "claim 5, 5, 8 or 9," should read --claim 5, 6, 8 or 9,--.

Signed and Sealed this

Eleventh Day of September, 1990

*Attest:*

HARRY F. MANBECK, JR.

*Attesting Officer*

*Commissioner of Patents and Trademarks*